US006388550B1

(12) United States Patent
Kanetaka et al.

(10) Patent No.: US 6,388,550 B1
(45) Date of Patent: May 14, 2002

(54) CHIP INDUCTOR AND ITS MANUFACTURING METHOD

(75) Inventors: Toyonori Kanetaka, Toyooka; Toshihiro Yoshizawa, Osaka; Akira Fujimori, Toyooka; Mikio Taoka, Neyagawa; Hideaki Nakayama, Toyooka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/570,927

(22) Filed: May 15, 2000

Related U.S. Application Data

(62) Division of application No. 09/147,314, filed as application No. PCT/JP98/01349 on Mar. 26, 1998, now Pat. No. 6,084,500.

(30) Foreign Application Priority Data

Mar. 28, 1997 (JP) ..... 9-76989
Mar. 28, 1997 (JP) ..... 9-76990

(51) Int. Cl.[7] ..... H01F 5/00; H01F 7/06

(52) U.S. Cl. ..... 336/223; 336/200; 336/232; 29/602.1; 29/606

(58) Field of Search ..... 336/83, 200, 223, 336/232; 29/606, 609, 602.1

(56) References Cited

U.S. PATENT DOCUMENTS 3,812,442 A 5/1974 Muckelroy
5,441,783 A * 8/1995 Silgailis et al. ..... 428/37
5,764,126 A 6/1998 Kanetaka et al.

FOREIGN PATENT DOCUMENTS

| | | | |
|---|---|---|---|
| EP | 0 065 147 A1 | | 4/1982 |
| EP | 0 785 559 A1 | | 7/1997 |
| JP | 06-215950 | * | 8/1994 |
| JP | 9-55321 | | 2/1997 |

* cited by examiner

*Primary Examiner*—Anh Mai
(74) *Attorney, Agent, or Firm*—McDermott, Will & Emery

(57) ABSTRACT

The invention relates to a chip inductor and its manufacturing method, in which an appropriate insulation is applied between adjacent linear conductors of the coil unit to prevent occurrence of short-circuit and to enhance electric characteristics, and moreover the mounting surface by the exterior unit is a flat surface, so that appropriate mounting is realized. The constitution includes a square columnar main body (1) made of an insulating material, electrode units (6) disposed at both ends of this main body (1), a coil unit (5) connected to the electrode units (6) and disposed on the outer circumference of the main body (1) between the electrode units (6), and an exterior unit (9) having this coil unit (5) coated with an insulating resin (8), in which the coil unit (5) includes linear conductors (3) and grooves (4) formed by grooving a conductor layer (2) covering the surface of the main body (1), and the insulating resin (8) is also formed in the entire inside of the grooves (4).

20 Claims, 7 Drawing Sheets

CHIP INDUCTOR AND ITS MANUFACTURING METHOD

This application is a Divisional of application Ser. No. 09/147,314 filed Nov. 25, 1998, U.S. Pat. No. 6,084,500 which is a 371 application of PCT/JP98/01349 filed Mar. 26, 1998.

TECHNICAL FIELD

The present invention relates to a chip inductor used in electronic appliances, communication appliances, and others, and its manufacturing method.

BACKGROUND ART

In FIG. 6 to FIG. 9, a conventional chip inductor comprises a square columnar main body 21 made of an insulating material, a coil unit 25 having a linear conductor 23 and a groove 24 formed by spirally grooving a conductor layer 22 on the surface of the main body 21, an exterior unit 29 made of an insulating resin 28 applied on the surface of the coil unit 25, and an electrode unit 26 provided at the end portion of the main body 21.

Its manufacturing method comprises a first step of forming a conductor layer 22 on a square columnar main body 21 made of an insulating material, a second step of forming a coil unit 25 having a linear conductor 23 and a groove 24 by grooving the conductor layer 22 by laser 27, a third step of forming electrode units 26 at both ends of the coil unit 25, and a fourth step of forming an exterior unit 29 by coating the coil unit 25 with an insulating resin 28 and drying.

Herein, at the fourth step, while rotating the main body 21 forming the coil unit 25 in the direction of arrow A in FIG. 9(*c*), on the tape to which the insulating resin 28 is adhered, the insulating resin 28 is applied on the coil unit 25, and the entire circumference of the coil unit 25 is coated with the insulating resin 28.

By drying this insulating resin 28, the exterior unit 29 is formed.

In such conventional constitution, the insulating resin 28 is applied on the surface of the coil unit 25, but the insulating resin 28 was not applied in the inner part of the groove 24 of the coil unit 25.

Generally, in a very small part such as chip inductor (overall dimension being about 1 mm), the interval of adjacent linear conductors 23 in the coil unit 25 is as narrow as scores of microns, and it is hard to coat the insulating resin 28 due to effects of surface tension and others of the insulating resin 28, and coated portions and uncoated portions of the insulating resin 28 coexisted inside the groove 24.

As a result, gaps 40 were formed inside the groove 24 as shown in FIG. 7, and due to air or moisture in the gaps 40, appropriate insulation is not provided between the adjacent linear conductors 23 of the coil unit 25, and short-circuit is caused.

Also in the conventional method, since the insulating region 28 is applied on the coil unit 25 while rotating the main body 21 forming the coil unit 25 on the tape to which the insulating resin 28 is adhered, as shown in FIG. 8, the insulating resin 28 applied on the coil unit 25 forms a circular profile, while surrounding the square columnar main body 21 due to the surface tension.

As a result, the mounting surface by the exterior unit 29 is round, and when mounting a packed substrate or the like, accurate mounting is difficult, and gaps 40 are likely to be formed in the groove 24.

DISCLOSURE OF THE INVENTION

It is hence an object of the invention to present a chip inductor capable of preventing short-circuit and enhancing the electric characteristics by applying an appropriate insulation between adjacent linear conductors of the coil unit, and mounting appropriately by forming a flat mounting surface in the exterior unit, and its manufacturing method.

To achieve the object, the invention is characterized by a constitution comprising a square columnar main body made of an insulating material, electrode units disposed at both sides of the main body, a coil unit connected to the electrode units, and disposed on the outer circumference of the main body between the electrode units, and an exterior unit having the coil unit coated with an insulating resin, in which the coil unit has linear conductors and grooves formed by grooving the conductor layer applied on the surface of the main body, and the insulating resin is also provided in the entire inside of the grooves.

Its manufacturing method comprises a first step of forming a conductor layer on a square columnar main body made of an insulating material, a second step of forming a coil unit having linear conductors and grooves by grooving the conductor layer, a third step of forming electrode units at both ends of the coil unit, and a fourth step of forming an exterior unit by coating the coil unit with an insulating resin and drying, in which the fourth step is intended to form the exterior unit by first coating the coil unit formed on one side of the main body with an insulating resin and drying, then coating the coil unit formed on other side with an insulating resin and drying.

In this constitution, since the insulating resin is provided also in the entire inside of the groove, there is no gap in the groove, and air or moisture is forced out, and appropriate insulation can be applied between linear conductors, so that short-circuit can be prevented.

Also, in this method, in the coil unit formed on the surface to which the main body is adjacent, the insulating resin is applied and dried on the coil unit formed at one side, and then the insulating resin is applied and dried on the coil formed at other side, thereby forming the exterior unit. In this case, the insulating resins applied on the coil units at the adjacent sides are not formed in a circular external shape due to mutual effects of surface tension because one side is already cured. Moreover, since the area of applying and drying the insulating resin in one step is small, the surface tension is smaller, and the insulating resin is easily applied in the entire inside of the groove.

As a result, in the square columnar main body, the insulating resin is also applied in a square columnar form, and an exterior unit of square columnar form is fabricated, and the mounting surface on the exterior unit is flat, and mounting on packed substrate or the like is improved, and the insulating resin may be easily applied to the entire inside of the groove of the coil unit.

BEST MODE FOR CARRYING OUT THE INVENTION

A chip inductor in an embodiment of the invention is described in detail below by referring to the accompanying drawings.

Figure 1:
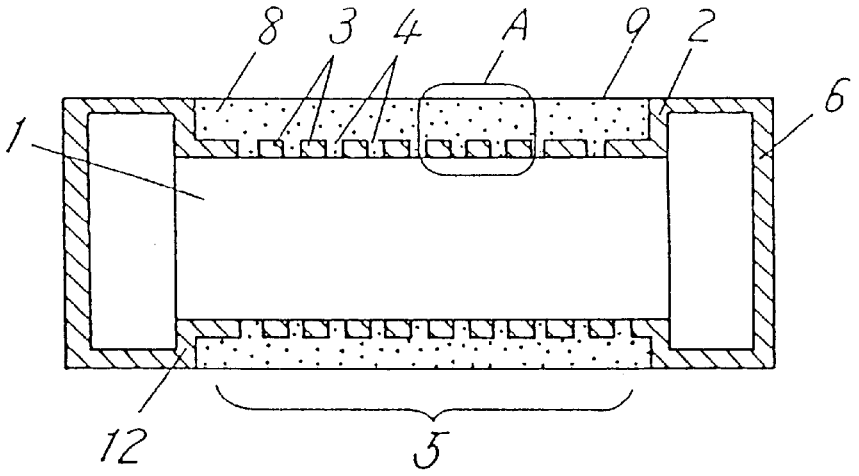
FIG. 1 is a sectional view of a chip inductor in an embodiment of the invention.
Figure 2:
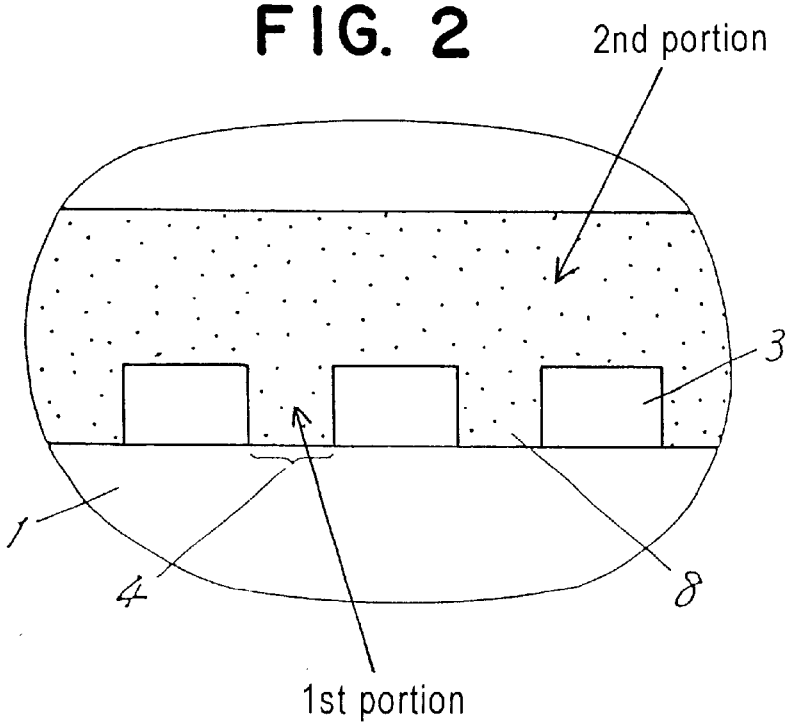
FIG. 2 is a magnified sectional view near the coil unit (part A in FIG. 1) of the same chip inductor.
Figure 3:
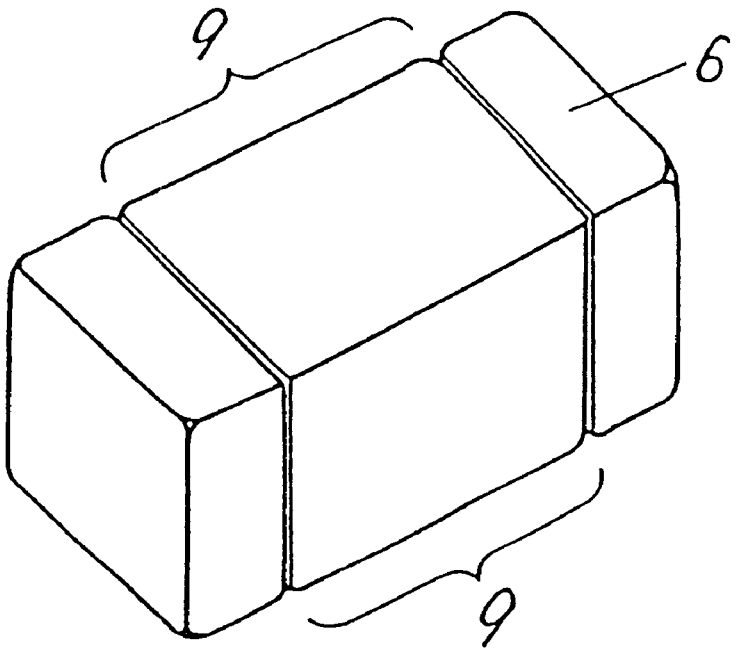
FIG. 3 is a perspective view of the same chip inductor, FIG. 4(*a*) to (*e*) are perspective views showing a series of forming steps of the chip inductor, and FIG. 5(*a*) to (*c*) are sectional views showing the formed state of the exterior unit of the same chip inductor.
Figure 4A:
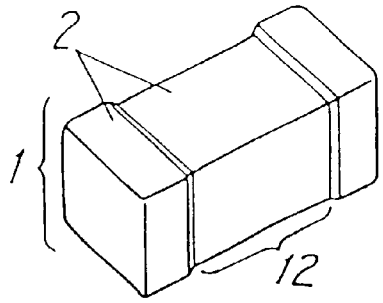
Figure 4B:
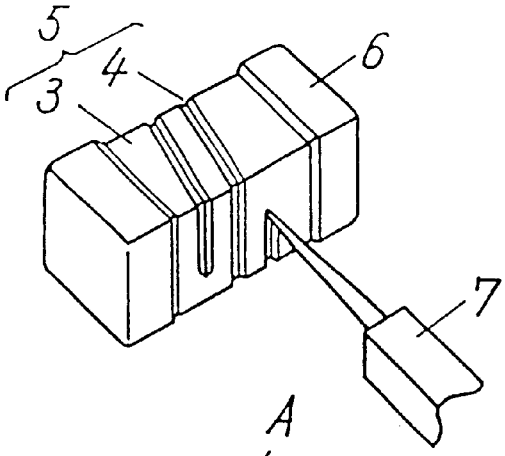
Figure 4C:
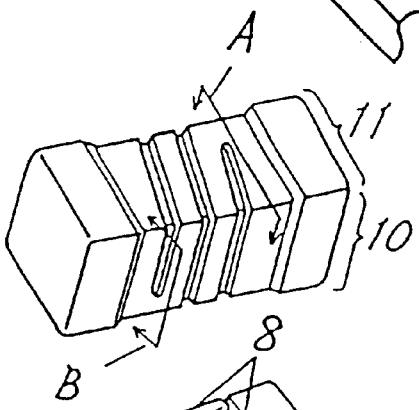
Figure 4D:
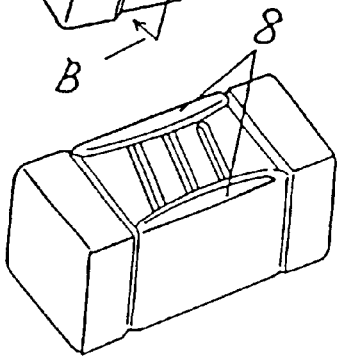
Figure 4E:
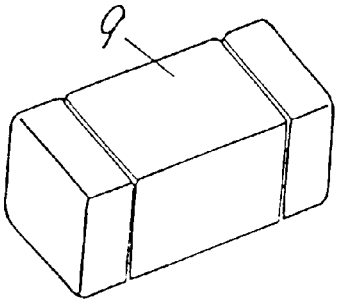
Figure 5A:
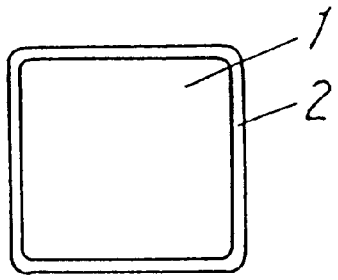
Figure 5B:
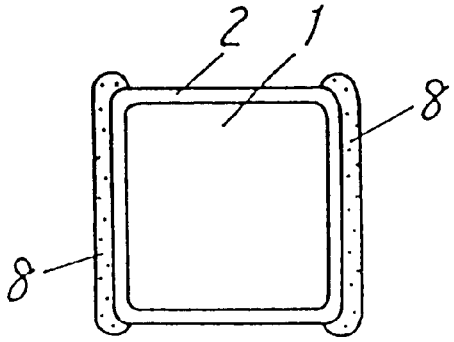
Figure 5C:
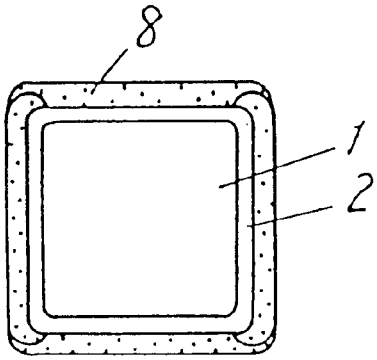
Figure 6:
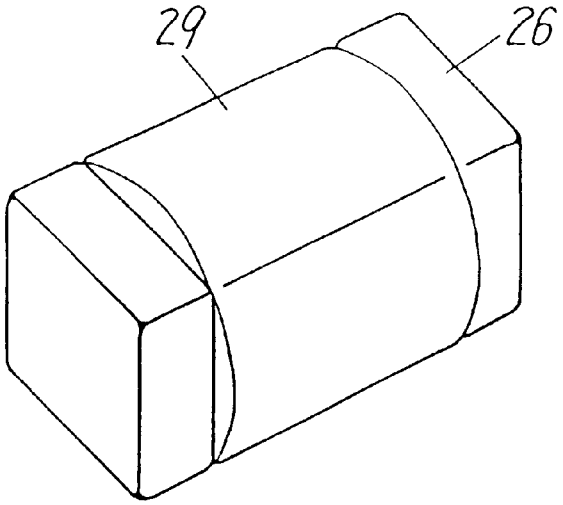
FIG. 6 PRIOR ART
FIG. 6 is a perspective view of a conventional chip inductor.
Figure 7:
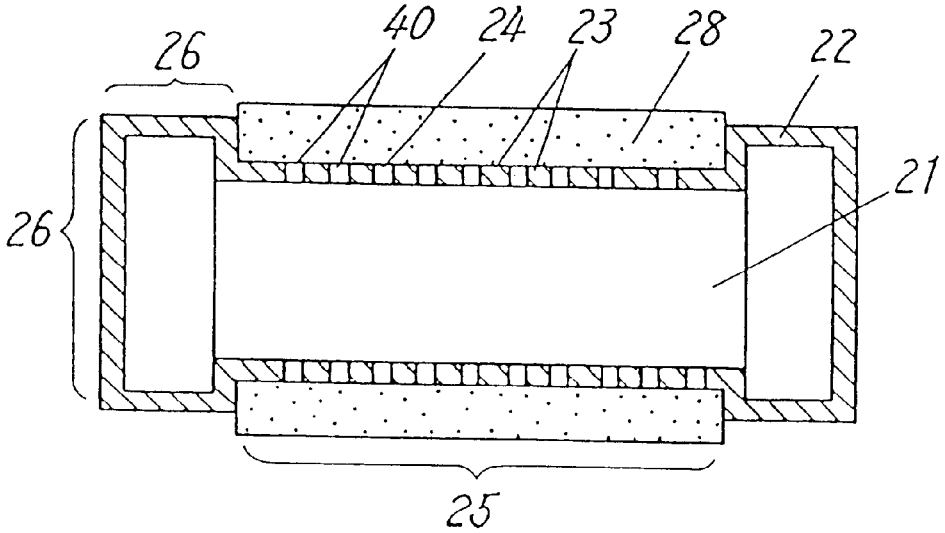
FIG. 7 PRIOR ART
FIG. 7 is a sectional view of the same chip inductor.
Figure 8:
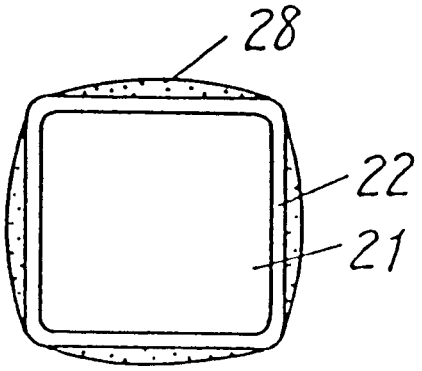
FIG. 8 PRIOR ART
FIG. 8 is a sectional view showing the formed sate of the exterior unit of the same chip inductor, and FIG. 9(*a*) to (*d*) are perspective views showing a series of forming steps of the same chip inductor.
Figure 9A:
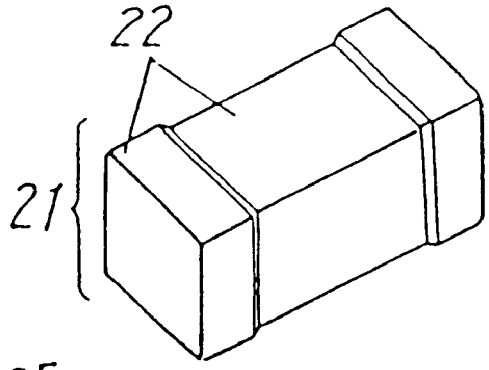
FIG. 9(a) PRIOR ART
Figure 9B:
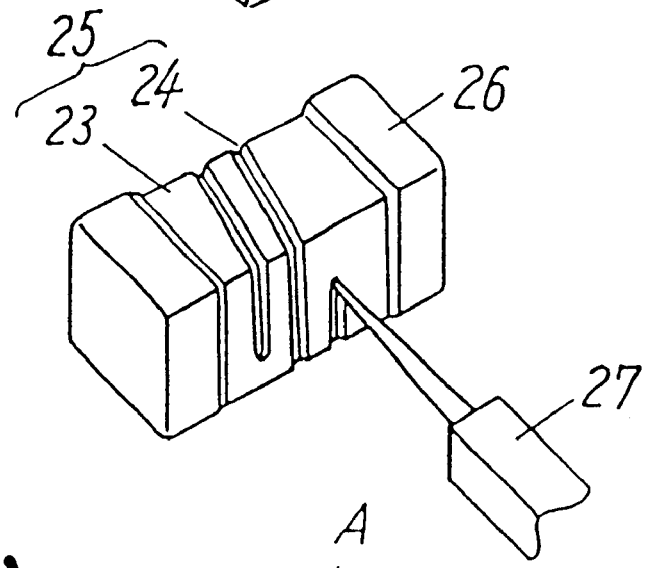
FIG. 9(b) PRIOR ART
Figure 9C:
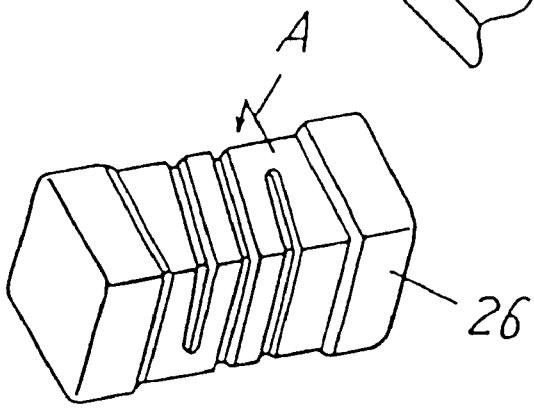
FIG. 9(c) PRIOR ART
Figure 9D:
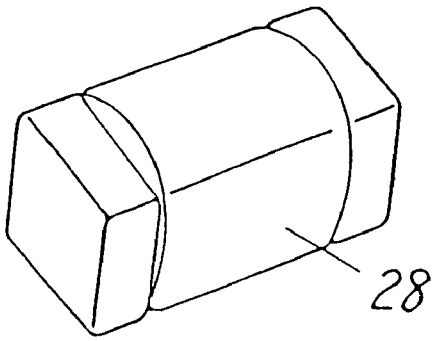
FIG. 9(d) PRIOR ART

In FIG. 1 to FIG. 5, a chip inductor in an embodiment of the invention comprises a square columnar main body 1 made of an insulating material, electrode units 6 disposed at both ends of this main body 1, a coil unit 5 connected to the electrode units 6 and disposed on the outer circumference of the main body 1 between the electrode units 6, and an exterior unit 9 having the coil unit 5 coated with an insulating resin 8.

The coil unit 5 includes linear conductors 3 and grooves 4 formed by grooving a conductor layer 2 covering the surface of the main body 1, and the insulating resin 8 is also formed in the entire inside of the grooves 4.

Further, recesses 12 are formed in all side surfaces except for the end surface of the main body 1, and the coil unit 5 is formed in the recesses 12, and the insulating resin 8 is formed inside the recesses 12.

The insulating resin 8 is a thixotropic epoxy resin.

Its manufacturing method comprises a first step of forming a conductor layer 2 on a square columnar main body 1 made of an insulating material, a second step of forming a coil unit 5 having linear conductors 3 and grooves 4 by grooving the conductor layer 2 by laser 7, a third step of forming electrode units 6 at both ends of the coil unit 5, and a fourth step of forming an exterior unit 9 by coating the coil unit 5 with an insulating resin 8 and drying.

The second step also includes a step of removing conductor chips formed when grooving the conductor layer 2, in which etching removal method, sand blasting removal method, or the like is employed.

At the fourth step, moreover, in the coil unit 5 formed at adjacent sides of the main body 1, after coating the coil unit 5 formed at one side 10 in direction A in FIG. 4(*c*) with the insulating resin and drying, the coil unit 5 formed at other side in direction B in FIG. 4(*c*) is coated with the insulating resin 8 and dried, thereby forming the exterior unit 9.

At this time, the main body 1 has a square columnar shape, and recesses 12 are formed in all sides of the main body 1, and the coil unit 5 is provided in the recesses 12, and, at the fourth step, after coating the coil unit 5 formed at one confronting side 10 of the main body 1 with the insulating resin 8 and drying, the coil unit 5 formed in other confronting side 11 is coated with the insulating resin 8 and dried to form the exterior unit 9, and the insulating resin 8 is formed within the recess 12 so as not to ooze outside of the recess 12.

When coating with the insulating resin 8, the entire inside of the groove 4 is also coated, and a transfer coating process by a roller is employed.

The insulating resin 8 used herein is a thixotropic epoxy resin.

The operation of the chip inductor having such constitution is described below.

Since the insulating resin 8 is provided also in the entire inside of the grooves 4, there is no gap in the grooves 4, and air or moisture is forced out, and an appropriate insulation is guaranteed between the adjacent linear conductors 3, and short-circuit can be prevented.

In the recess 12 having the coil unit 5, at least the insulating resin 8 is provided, and therefore the level of the insulating resin 8 is not higher than the level of the electrode units 6 at both sides of the recess 12, and the square columnar plane of the main body 1 can be used as the mounting surface, and the mounting performance on packed substrate or the like is improved. In particular, since the recess 12 is formed in all sides except for the end face of the main body 1 to cover the insulating resin 8, it is possible to mount on any side, and the productivity is enhanced.

Moreover, since the insulating resin 8 is a thixotropic epoxy resin, shape change does not occur when curing the insulating resin 8, and the surface shape of the exterior unit 9 can be accurately defined in a plane, and the mounting performance may be enhanced.

Also according to this manufacturing method, in the coil units 5 formed at adjacent sides of the main body 1, after coating the coil unit 5 formed at one side 10 with the insulating resin 8 and drying, the coil unit 5 formed in other side 11 is coated with the insulating resin 8 and dried to form the exterior unit 9. In this case, of the insulating resins 8 applied on the coil units 5 at the adjacent sides, since one side has been already cured, the external shape does not become circular due to mutual effects of surface tension.

Still more, the area of coating with the insulating resin 8 and drying in one step is smaller, and the surface tension is smaller, and therefore it is easy to coat the entire inside of the groove 4 with the insulating resin 8.

As a result, in the square columnar main body 1, the insulating resin 8 is also applied in a square columnar shape, and the square columnar exterior unit 9 is formed, and the mounting surface by the exterior unit 9 is a flat shape, and the mounting performance on a packed substrate or the like may be enhanced.

Since the coil units 5 formed at the confronting one side 10 and other side 11 of the main body 1 are coated with the insulating resin 8 and dried, the process of forming the exterior unit 9 on the main body 1 is finished in two steps, and the manufacture may be simplified.

Since the entire inside of the groove 4 is coated with the insulating resin 8, gap is not formed in the groove 4, and corrosion or short-circuit between the adjacent linear conductors 3 due to air or moisture in the gap may be prevented, and it is also effective to prevent short-circuit between the adjacent linear conductors 3 by conductor chips or other dust formed at the time of grooving the conductor layer 2.

Since the insulating resin 8 is formed in the recess 12 provided in the sides of the main body 1, the level of the insulating resin is not higher than the level of the electrode units 6 at both ends of the recess 12, and the mounting performance on a packed substrate or the like may be enhanced.

Since conductor chips formed when grooving the conductor layer 2 are removed, it is effective to prevent short-circuiting between the adjacent linear conductors 3 due to the conductor layer of a conductive matter, or prevent change of inductance value due to deposit on the linear conductors 3, thereby enhancing the electric characteristics.

Since the insulating resin 8 is a thixotropic epoxy resin, when coated with the insulating resin 8, the exterior unit 9 can be formed by drying and curing while maintaining the shape of coating. As a result, shape changes when curing the insulating resin 8 are smaller, the shape of the surface of the exterior unit 9 can be defined, and the mounting performance is enhanced.

Moreover, since the insulating resin 8 is applied by transfer coating process, the insulating resin 8 can be applied very sparingly and uniformly. Therefore, the sectional area of the main body 1 may be extended to the maximum limit, and the size can be reduced while maximizing the inductance value attributable to the sectional area of the main body 1.

Thus, according to the invention, there is no gap in the grooves 4, and air or moisture is forced out, and an appropriate insulation is guaranteed between the linear conductors 3, and short-circuit can be prevented, and therefore the electric characteristics may be enhanced.

The level of the insulating resin 8 is not higher than the level of the electrode units 6 at both sides of the recess 12, and the square columnar plane of the main body 1 can be used as the mounting surface, and the mounting performance on packed substrate or the like is improved, and moreover, since the recess 12 is formed in all sides except for the end face of the main body 1 to cover the insulating resin 8, it is possible to mount on any side, and the productivity is enhanced.

Moreover, since the insulating resin 8 is a thixotropic epoxy resin, shape change does not occur when curing the insulating resin 8, and the surface shape of the exterior unit 9 can be accurately defined in a plane, and the mounting performance may be enhanced.

Also according to this manufacturing method, in the square columnar main body 1, the insulating resin 8 is also applied in a square columnar shape, and the square columnar exterior unit 9 is formed, and the mounting surface by the exterior unit 9 is a flat shape, and the insulating resin 8 is provided in the recess 12 formed at the side of the main body 1, and therefore the level of the insulating resin is not higher than the level of the electrode units 6 at both ends of the recess 12, and the mounting performance on packed substrate or the like is enhanced. In particular, since the insulating resin 8 is a thixotropic epoxy resin, the shape of the surface the exterior unit 9 can be defined, and the mounting performance may be further improved.

Since the insulating resin 8 is also applied in the gap, corrosion or short-circuit between adjacent linear conductors 3 can be prevented, and deterioration in use in high frequency current region can be suppressed, and further by transfer coating process, the insulating resin 8 can be applied very sparingly and uniformly, and the size may be reduced while maximizing the inductance value.

Conductor chips formed when grooving the conductor layer 2 are removed, which prevents occurrence of short-circuit between the adjacent linear conductors 3 due to the conductive matter formed by conductor chips or change of inductance value due to deposit on the linear conductor 3, thereby enhancing the electric characteristics.

Since the coil unit 5 formed at the confronting one side 10 of the main body 1 and the coil unit 5 formed at the confronting other side 11 are coated with the insulating resin 8 and dried, the process of forming the exterior unit 9 on the main body 1 is finished in two steps, and the manufacture may be simplified.

Meanwhile, in the embodiment of the invention, the exterior unit 9 is formed on the main body 1 in two steps, but the exterior unit may be also formed in several steps, by applying and drying the insulating resin 8 sequentially in each side of the side surfaces of the main body 1.

Incidentally, the method of removing conductor chips may be also other method than the etching removal method or sand blasting removal method.

INDUSTRIAL APPLICABILITY

Thus, the invention is characterized by a constitution comprising a square columnar main body made of an insulating material, electrode units disposed at both sides of the main body, a coil unit connected to the electrode units, and disposed on the outer circumference of the main body between the electrode units, and an exterior unit having the coil unit coated with an insulating resin, in which the coil unit has linear conductors and grooves formed by grooving the conductor layer applied on the surface of the main body, and the insulating resin is provided also in the entire inside of the grooves.

In this constitution, since the insulating resin is provided also in the entire inside of the groove, there is no gap in the groove, and air or moisture is forced out, and appropriate insulation can be applied between linear conductors, so that short-circuit can be prevented, and therefore the chip inductor enhanced in the electric characteristics can be presented.

Its manufacturing method comprises a first step of forming a conductor layer on a square columnar main body made of an insulating material, a second step of forming a coil unit having linear conductors and grooves by grooving the conductor layer, a third step of forming electrode units at both ends of the coil unit, and a fourth step of forming an exterior unit by coating the coil unit with an insulating resin and drying, in which the fourth step is intended to form the exterior unit by first coating the coil unit formed on one side of the main body with an insulating resin and drying, then coating the coil unit formed on other side with an insulating resin and drying.

Also, in this method, in the coil unit formed on the surface to which the main body is adjacent, the insulating resin is applied and dried on the coil unit formed at one side, and then the insulating resin is applied and dried on the coil formed at other side, thereby forming the exterior unit. Therefore, the insulating resins applied on the coil units at the adjacent sides are not formed in a circular external shape due to mutual effects of surface tension because one side is already cured.

As a result, in the square columnar main body, the insulating resin is also applied in a square columnar form, and an exterior unit of square columnar form is fabricated, and the mounting surface on the exterior unit is flat, so that a chip inductor enhanced in mounting on packed substrate or the like is presented.

What is claimed is:

1. A chip inductor comprising:

a main body having both ends and sides, said main body having an electric insulating property, electrode units disposed at both ends of said main body, a coil unit disposed on an outer circumference of the sides of the main body between each of said electrode units, in which said coil unit has a linear conductor formed by grooving a conductor layer disposed on the surface of the outer circumference of the main body, grooves enclosed by said conductor, and an electric insulating member including a first electric insulating portion and a second electric insulating portion, said first electric insulating portion disposed to fill up all gaps in said grooves, and said second electric insulating portion disposed to cover said linear conductors and said first electric insulating portion.

2. The chip inductor of claim 1, wherein said main body has a square columnar shape.

3. The chip inductor of claim 1, wherein the surface of said sides of the main body has a recess, said second electric insulating portion is put into the recess, and a surface of the second electric insulating portion is positioned at least at the same position of a line linking the both ends and at an inside position of said line.

4. The chip inductor of claim 1, wherein the surface of said sides of the main body has a recess formed in an entire area except for both ends, said coil is put into the recess, and said second electric insulating portion is put into said recess to cover the coil.

5. The chip inductor of claim 1, wherein at least one of said first electric insulating portion and said second electric insulating portion is formed by using a resin material of thixotropic property.

6. The chip inductor of claim 1, wherein at least one of said first electric insulating portion and said second electric insulating portion is formed by using an epoxy resin material of thixotropic property.

7. The chip inductor of claim 1, wherein a width of a groove is about tens of microns.

8. The chip inductor of claim 1, wherein said main body has a square columnar shape having at least four sides, said electric insulating member is formed in a process of placing the electric insulating member on a first side of the at least four sides, drying said first electric insulating member on said first side, and after drying said first electric insulating member on said first side, then placing the electric insulating member on a second side of the at least four sides, and no gap is left in the groove.

9. The chip inductor of claim 1, wherein said main body has a square columnar shape having at least four sides, each surface of said at least four sides has a recess, the second electric insulating portion is put into the recess, and a surface of said second electric insulating portion is positioned at the same position as a plane connecting the both ends.

10. The chip inductor of claim 1, wherein said main body has a square columnar shape having at least four sides, each surface of said at least four sides has a recess, said second electric insulating portion is put into the recess, and a surface of the second electric insulating portion is positioned inside of the plane connecting the both ends.

11. The chip inductor of claim 1, wherein said main body has a square columnar shape having at least four sides, and said second electric insulating portion has a square columnar shape coinciding with the shape of the at least four sides.

12. The chip inductor of claim 1, wherein the surface of said sides of the main body has a recess formed in an entire area except for both ends, said coil is put into the recess, said second electric insulating portion is put into said recess to cover the coil, and at least one of said first electric insulating portion and said second electric insulating portion is formed by using a resin material of thixotropic property.

13. A manufacturing method of a chip inductor comprising:

a first step of forming a conductor layer on a square columnar main body made of an insulating material, a second step of forming a coil unit having a linear conductor and a groove by cutting off said conductor layer, a third step of forming electrode units at both ends of said coil unit, and a fourth step of covering said coil unit with an insulating resin, and drying, wherein said fourth step includes:

coating the insulating resin at a first side of said main body by a first coating, drying said insulating resin coated at said first side, then, coating the insulating resin at a second side of said main body by a second coating, and drying said insulating resin coated at said second side.

14. The manufacturing method of a chip inductor of claim 13, wherein said main body has a third side which is positioned at the back side of said first side, said first side and said third side of the main body are coated with said insulating resin by said first coating, and said insulating resin coated at said first side and said third side are dried, and then, said main body has a fourth side which is positioned at the back side of said second side, said second side and said fourth side of said main body are coated by said second coating, and said insulating resin coated at said second side and said fourth side are dried.

15. The manufacturing method of a chip inductor of claim 13, further comprising a step of forming a recess in each side of said square columnar main body, between said first step and said second step, wherein said coil unit is formed in said recess, said main body has a third side which is positioned at the back side of said first side, said first side and said third side of the main body are coated with said insulating resin by said first coating and said insulating resin coated at said first side and said third side are dried, and then, said main body has a fourth side which is positioned at the back side of said second side, said second side and said fourth side of said main body are coated by said second coating, and said insulating resin coated at said second side and said fourth side are dried.

16. The manufacturing method of a chip inductor of claim 13, further comprising a step of filling an entire inside of said groove with said insulating resin.

17. The manufacturing method of a chip inductor of claim 13, further comprising a step of removing a waste conductor produced when cutting off said conductor layer.

18. The manufacturing method of a chip inductor of claim 13, wherein said insulating resin is a thixotropic epoxy resin.

19. The manufacturing method of a chip inductor of claim 13, wherein said fourth step includes a step of coating said insulating material by transfer coating process.

20. The manufacturing method of a chip inductor of claim 13, wherein an entire inside of said groove is filled with said insulating resin.

* * * * *

UNITED STATES PATENT AND TRADEMARK OFFICE

CERTIFICATE OF CORRECTION

PATENT NO. : 6,388,550 B1
DATED : May 14, 2002
INVENTOR(S) : Toyonori Kanetaka et al.

It is certified that error appears in the above-identified patent and that said Letters Patent is hereby corrected as shown below:

Title page,
Item [62], Related U.S. Application Data, replace "Division of application No. 09/147,314, filed as application No. PCT/JP98/01349 on Mar. 26, 1998, now Pat. No. 6,084,500." with -- Division application of No. 09/147,314, filed November 25, 1998, now Patent No. 6,084,500, which is a 371 application of PCT/JP98/01349, filed March 26, 1998 --

Signed and Sealed this

Twenty-fourth Day of December, 2002

JAMES E. ROGAN
*Director of the United States Patent and Trademark Office*